US006499227B1

(12) United States Patent
Jacobson

(10) Patent No.: US 6,499,227 B1
(45) Date of Patent: Dec. 31, 2002

(54) DRYING ACCESSORY FOR SPORTS GLOVES

(76) Inventor: Leon Jacobson, P.O. Box 1717, San Juan, PR (US) 00919-1717

( * ) Notice: Subject to any disclaimer, the term of this patent is extended or adjusted under 35 U.S.C. 154(b) by 0 days.

(21) Appl. No.: 09/723,212

(22) Filed: Nov. 28, 2000

Related U.S. Application Data

(60) Provisional application No. 60/222,381, filed on Aug. 2, 2000, and provisional application No. 60/191,194, filed on Mar. 22, 2000.

(51) Int. Cl.[7] ..... F26B 25/00

(52) U.S. Cl. ..... 34/106; 34/104; 34/105; 40/591; 40/661; 40/665

(58) Field of Search ..... 40/665, 591, 661; 34/103, 104, 106

(56) References Cited

U.S. PATENT DOCUMENTS 4,524,867 A * 6/1985 Hans-Jorg Klein et al. . 206/232
5,177,881 A * 1/1993 Moore ..... 34/239
5,864,925 A 2/1999 McGee
5,983,518 A * 11/1999 Ellenburg ..... 34/106

* cited by examiner

*Primary Examiner*—Ira S. Lazarus
*Assistant Examiner*—Kathryn S. O'Malley
(74) *Attorney, Agent, or Firm*—Morris E. Cohen

(57) ABSTRACT

Sports glove drying devices. In one embodiment, an accessory allows attachment of gloves to a vehicle. The aerodynamic drag of the wind against the vehicle during the vehicle's movement speeds up the drying of the gloves. In a further embodiment, an accessory for adhering to a vehicle, existing tags or so forth, allowing any surface to be utilized for drying the gloves. In further embodiments, the accessory includes a receptacle for interchanging promotional material therein. In a preferred embodiment, the accessories are used with golf gloves and can be attached to a golf cart. In alternate embodiments, the accessories can be used with any other sporting activity using gloves, such as bicycling, baseball, or so forth.

10 Claims, 11 Drawing Sheets

DRYING ACCESSORY FOR SPORTS GLOVES

RELATED APPLICATIONS

The present application claims the priority of U.S. Provisional Application Serial No. 60/222,381 filed Aug. 2, 2000, and the priority of U.S. Provisional Application Serial No. 60/191,194, filed Mar. 22, 2000, the disclosures of which are fully incorporated herein by reference.

FIELD OF THE INVENTION

The present invention relates to devices for drying gloves used in sporting activities, such as golf, bicycling, and so forth.

BACKGROUND OF THE INVENTION

Currently, specialty gloves are used in a variety of sporting activities. Golfers, for example, use special golfing gloves during play to improve their grip upon golf clubs. Similarly, bicyclers also utilize gloves during races to more firmly and comfortably grasp their bicycle's handlebars. Although these two sports are described for illustration purposes, athletes likewise utilize sporting gloves to improve their play and comfort in a variety of other sports as well.

During the course of the athletic event, the gloves frequently become wet from the sweat on the athlete's hands. Upon placement of the glove in the athlete's bag, that wet or moist glove is prone to become stiff, uncomfortable, unpleasant, crumpled and/or wrinkled, negatively impacting upon the tactile sensitivity of the hand, ruining the appearance of the glove, and making it more difficult to place the glove on the hand in subsequent uses.

Several devices have been provided in the art to address this problem with respect to golf gloves, to dry the golf gloves of an athlete. U.S. Pat. No. 5,177,881 issued on Jan. 12, 1993 to Moore ("the Moore patent"), and U.S. Pat. No. 5,86,925 issued on Feb. 2, 1999 to McGee ("the McGee patent") both disclose accessory devices for facilitating the drying of golf gloves during use. The McGee patent, for example, discloses a combined "bag tag" and glove drying apparatus which allows golfers to hang their gloves from the outside of a golf bag during play. The Moore patent discloses an accessory device for attachment of a golf glove directly to the golfer him or herself, either to the belt or clothing. Each of these devices, however, are limited in their purpose and utility, including the devices they can be attached to, and the rate at which the glove can be dried.

SUMMARY OF THE INVENTION

It is an object of the present invention to provide an improved device for drying sports gloves.

It is a further object of the present invention to provide devices for drying sports gloves which aerodynamically utilize the movement of a vehicle to improve the speed and efficiency of drying the glove.

It is a further object of the present invention to provide devices for drying sports gloves which can be integrated with existing tags and sports accessory devices.

It is a further object of the invention to provide a new form of sports advertising, including a new method and medium for marketing sports items, and for conveying advertising and promotional information.

The present invention can be utilized in conjunction with any type of gloves desired, whether gloves used in golf, baseball, football, soccer, fencing, weightlifting, scuba diving, or so forth.

Further objects of the invention will become apparent in conjunction with the disclosure herein.

In accordance with the present invention, devices are provided enhancing the ability of an athlete to quickly air dry his or her gloves after use.

In one embodiment of the invention, attachment devices are provided which allow the gloves to be attached to a moving vehicle (such as a golf cart or bicycle), exploiting the aerodynamic drag of the wind against the glove during movement of the vehicle to improve the speed and efficiency of drying.

In a preferred embodiment of the present invention, improvements are provided enhancing the ability of an athlete to quickly dry his or her gloves by attachment of the glove to a vehicle, while also providing promotional information from a sponsor or other entity. In one embodiment, the gloves can be attached to a golf art. In an alternate embodiment, a cyclist's gloves can be attached to his or her bicycle. In further alternate embodiments, the invention can be used by athletes in other sports, whether soccer, basketball, baseball, or so forth, wherein the athlete attaches his or her gloves to an object, preferably to a moving vehicle, or to an existing tag, or any other surface to air dry the gloves.

Further in accordance with the invention, a method is provided for drying sports gloves by using a moving vehicle. In a preferred embodiment, a method is provided for drying sports gloves by using a golfer's golf cart.

In a further embodiment of the invention, attachment devices are provided which allow existing tags of sports facilities to be readily modified for attachment of a glove thereto without needing replacement of the entire tag. In a further embodiment, the attachment device also provides promotional information from a sponsor or other entity.

Further objects and features of the invention will become apparent in conjunction with the disclosure herein.

BRIEF DESCRIPTION OF THE FIGURES

FIG. 3*a* is a front view of an card for attachment of a glove thereto. FIG. 3*b* is a perspective view of the card attached to a pole of a vehicle. FIG. 3*c* is a front view of a strap for attachment of the card to the pole. FIG. 3*d* is a side view of the strap FIG. 3*c*. FIG. 3*e* is the side view shown in FIG. 3*d,* upon further attachment of the strap to the pole of the vehicle.

FIG. 6(*a*) is a back view of the envelope, wherein the envelope is unassembled. FIG. 6(*b*) is a back view of the envelope with the self-standing accessory device of FIG. 4 positioned therein. FIG. 6(*c*) is a back view of the envelope in an assembled state with the self-standing accessory device of FIG. 4 therein. FIG. 6(*d*) is a front view of the envelope in an assembled state with the self-standing accessory device of FIG. 4 positioned therein to display desired material through a window in the envelope.

FIG. 7 illustrates a hanging card in a further embodiment of the invention.

FIG. 8*a* is a perspective view of the accessory attached to the pole of a vehicle without any promotional card therein. FIG. 8*b* is a perspective view of the accessory attached to the pole of a vehicle, showing a promotional card as it is being inserted. FIG. 8*c* is a perspective view of the accessory of FIGS. 8*a* and 8*b* after insertion of the card. This embodiment allows different promotional cards to be utilized with the same accessory by merely inserting the desired card in the receptacle.

DETAILED DESCRIPTION OF THE INVENTION AND THE PREFERRED EMBODIMENTS

In accordance with the present invention, devices and methods are provided for drying gloves. In the preferred embodiment, the invention is used by a golfer to air dry golf gloves. In alternate embodiments, other types of gloves can be dried, as discussed above. Thus, while the following discussion will be directed primarily to golf gloves, it will be understood that the invention can be used with other sports gloves as well, such as the gloves of a cyclist.

Figure 1A:
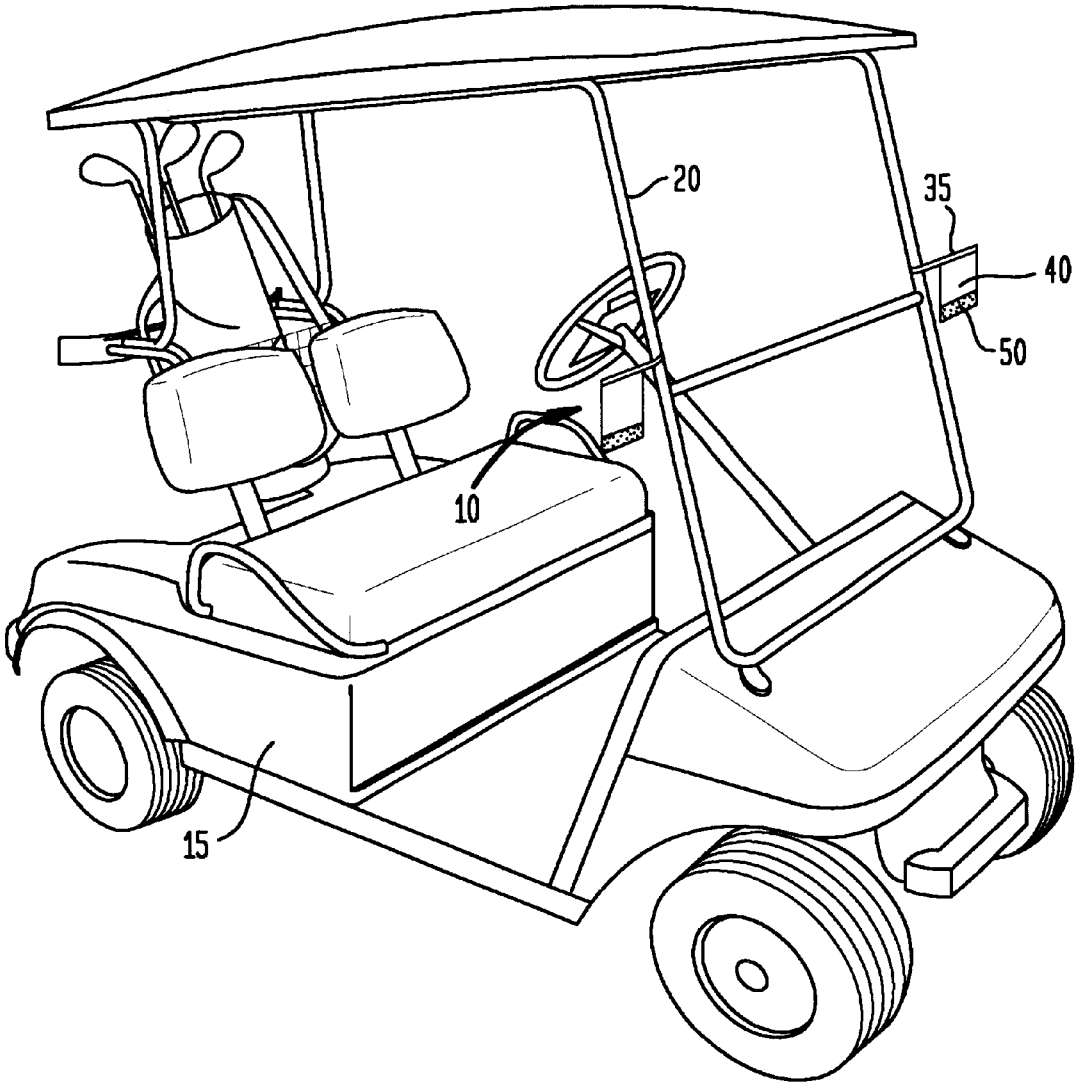
FIG. 1*a* is a perspective view of a vehicle having an accessory device attached thereto, in accordance with the present invention.
Figure 1B:
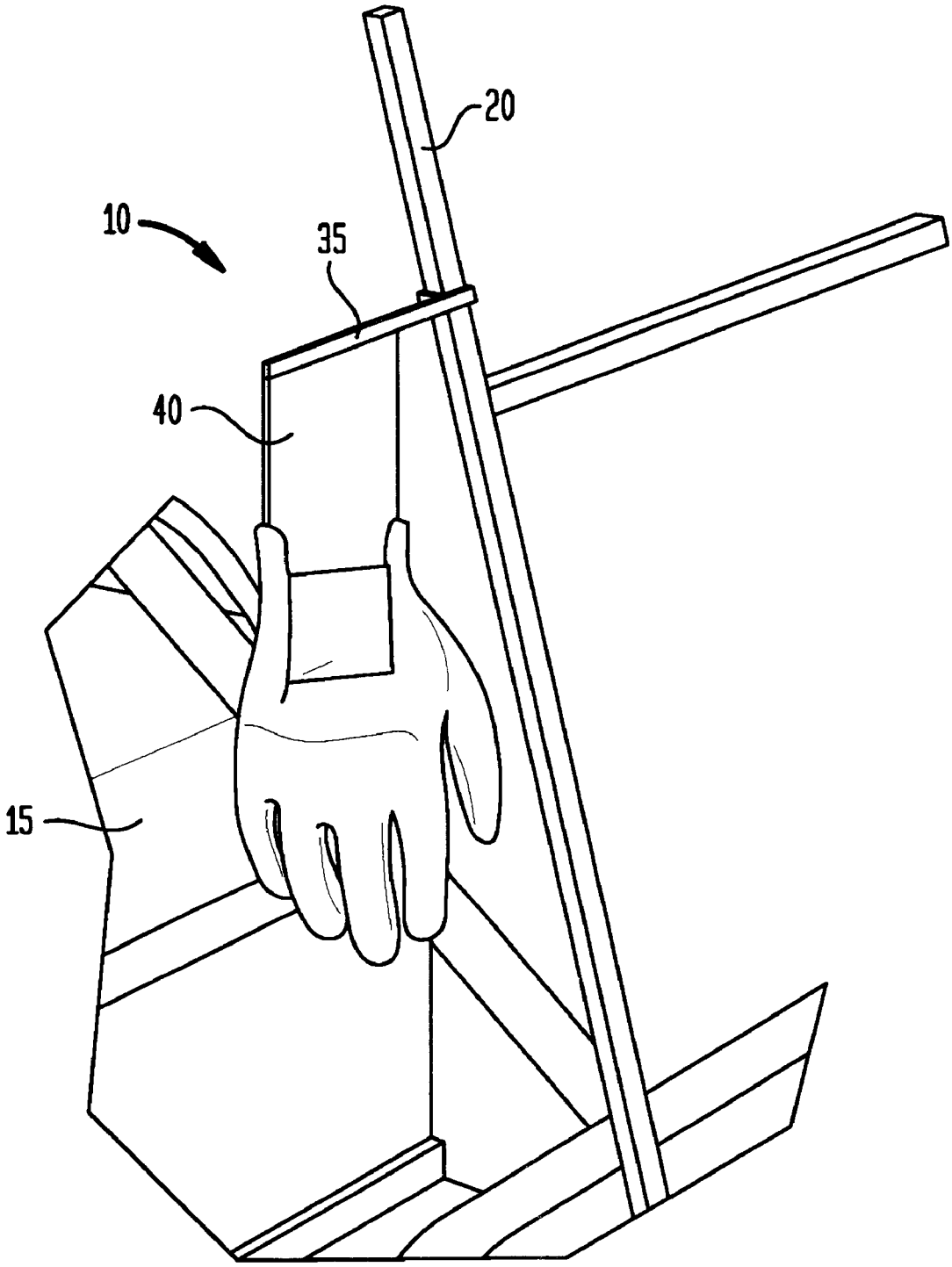
FIG. 1*b* is an enlarged view of a portion of FIG. 1*a,* showing the accessory device attached to the vehicle.

As shown in FIG. 1, an accessory 10 is provided for attachment to a vehicle 15, such as a standard golf cart. In the case of a golf cart, the accessory is attached to the upright pillars or poles 20 of the cart. Accessory 10 is designed to hold a sporting glove (such as a golf glove) securely, especially while the vehicle is being driven. Thus, the glove can be secured to the golf cart while the cart is being driven along a golf course to facilitate and expedite the drying of the glove.

Figure 2:
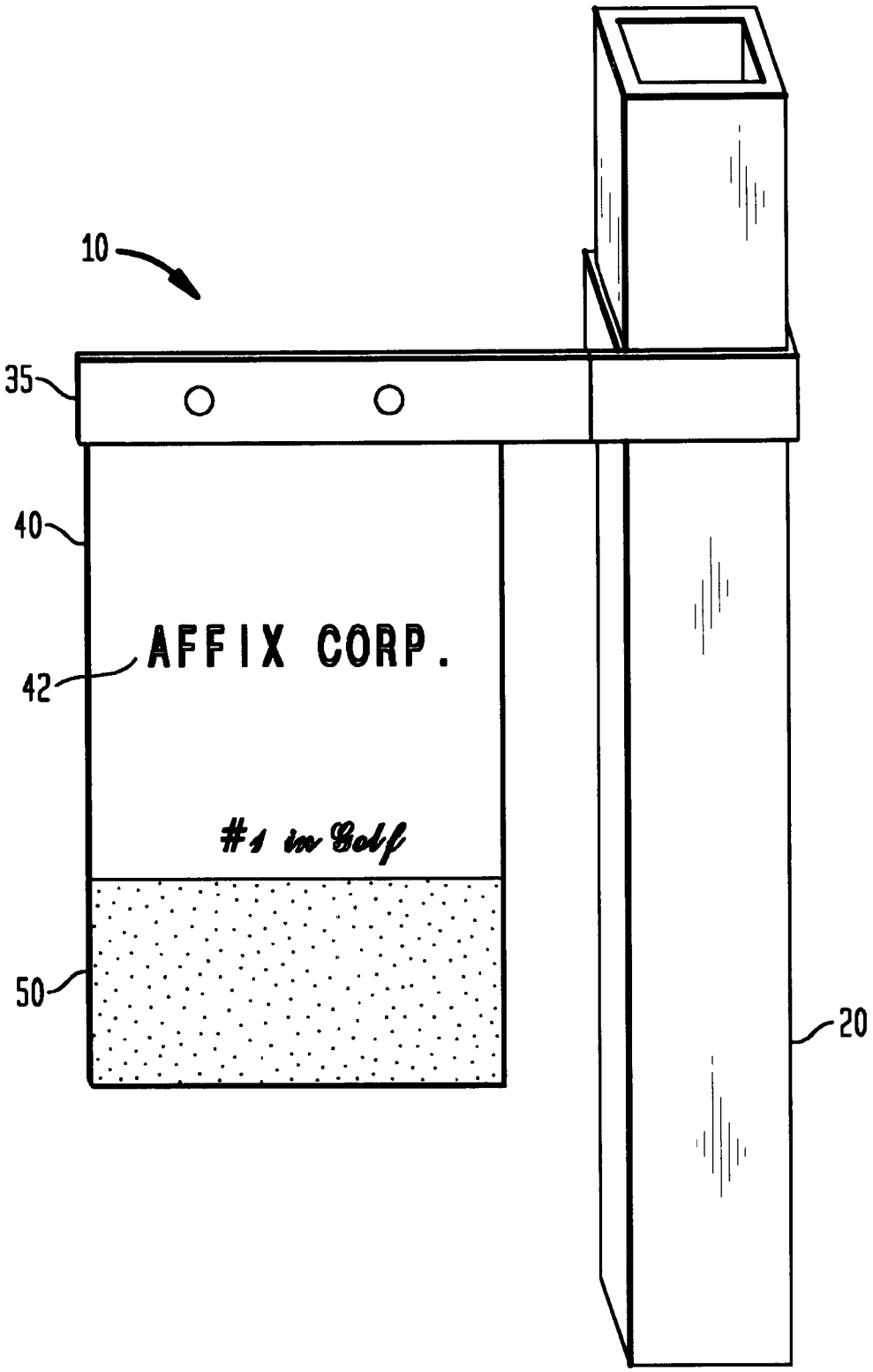
FIG. 2 is a perspective view of the accessory device of the present invention attached to a pole of a vehicle, such as a golf cart.
Figure 3A:
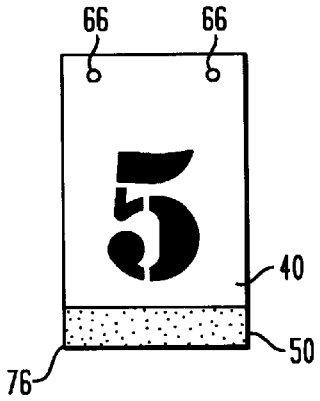
FIGS. 3*a*–3*e* are views of the accessory device of FIG. 2.
Figure 3B:
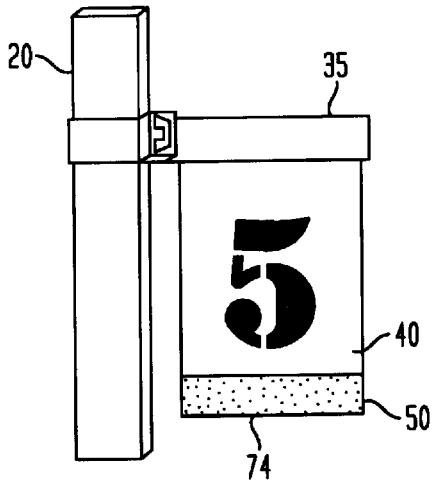
Figure 3C:
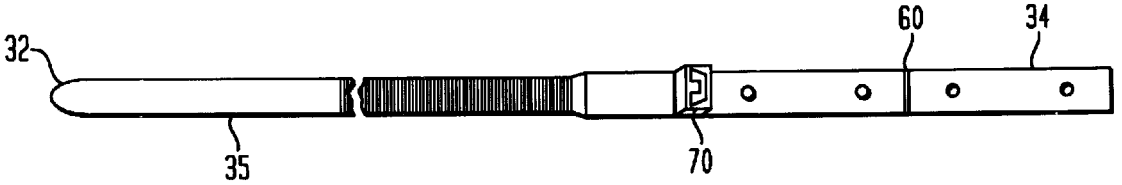
Figure 3D:
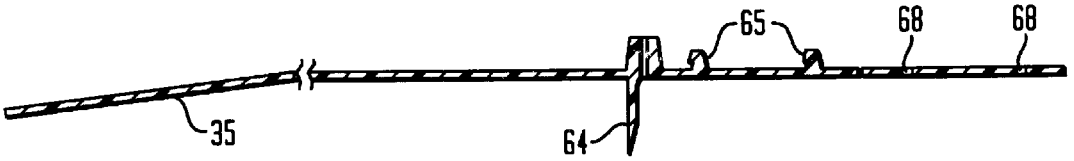
Figure 3E:
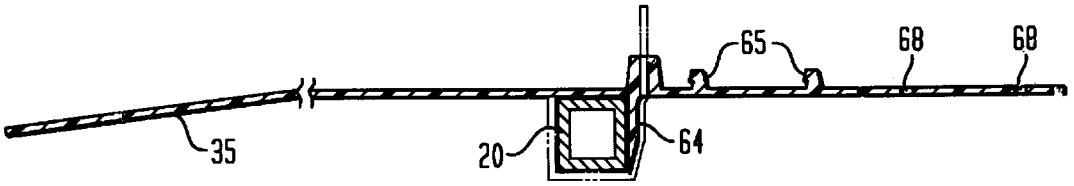

Further details regarding accessory 10 are provided in FIG. 2. In one embodiment, the accessory includes a vehicle securing device 35, such as a securing strap or a bar. Vehicle securing device 35 attaches to the golf cart pillars or poles 20. In an alternate embodiment, any other suitable device or method for attaching the card 40 to a vehicle can be provided consistent with the invention, whether by screwing the card into the pole, or so forth.

A preferred embodiment of the accessory is shown in FIG. 3. In the preferred embodiment, securing strap 35 is a well known type of strap as shown in the figure. The strap includes prongs 65, holes 68, a stop 64 and a hinge 60. Further in accordance with the invention, the hinge 60, holes 68, prongs 65 and stop 64 of strap 35 are sized to fit around the poles 20 of a golf cart 15.

Dimensions of a preferred embodiment are shown in FIG. 3. In the preferred embodiment, the total height of the card is approximately 3.25 inches and the width of the card is approximately 2.00 inches as shown in FIG. 3(*a*). Holes 68 are approximately 1.25 inches apart, as are the prongs 65. The holes can also be placed approximately 0.22 inches from the top of the card 40. Any other desired dimensions, however, can be utilized consistent with the invention.

Card 40 having holes 66 is placed onto the strap so that the prongs 65 extend through the holes 68, to secure the card 40 to the strap 35. The preferred width of the strap is 0.50 inches, and the length is as long as desired. A first end 34 of the strap 35 folds back along hinge 60 so that prongs 65 extend through holes 68. Thus, the card 40 is sandwiched between the folded halves of the strap, with the prongs extending first through the holes 66 of the card 40, and then through the holes 68 of end 34 of strap 35. When it desired to change the card (e.g. to put in a card with different promotional material or graphics), the prongs can be pulled out of the holes for easy card replacement.

The strap with the card is placed next to a square rod or a pole 20 of a vehicle, and the second end 32 of the strap 35 is wrapped around the pole 20. The end 32 is then pulled through the latch 70 of the strap 35 to secure the strap against the pole 20. The latch 70 holds the strap tightly, preventing it from coming out and ensuring that the strap is well secured to the pole. Preferably, the latch can be released to remove the strap from the vehicle when desired.

In an alternate embodiment, the strap or other vehicle securing device attaches to a bicycle. In one embodiment, the device secures to the handlebars. In alternate embodiments, the device secures to other parts of the bicycle. The device (whether for the bicycle or any other vehicle) can extend horizontally off of the vehicle (as shown in FIG. 2) or vertically off of the vehicle, as desired.

As discussed above, vehicle securing device 35 attaches to a display 40, such as a card. Display 40 can be constructed of any desired material, whether cardboard, plastic, metal or so forth. In a preferred embodiment, the card has space for display of a logo or image thereon. The logo or image is used for promotional purposes to advertise the goods and/or services of any desired party.

Card 40 further includes an glove attachment device 50. The glove attachment device can be adhered to the card (e.g. using adhesive), or attached to the card in any other desired manner. Likewise, the glove attachment device can be attached to the card to be integral with the card, or can be a separate piece (e.g. whose top attaches to the card's bottom). Glove attachment device 50 is preferably a hook and pile tape (also known as hook and loop tape). The Velcro such as VELCRO (hook and pile tape) is provided on both sides of the display 40, such that hook tape 76 are provided on one side of the display and pile tape 74 are provided on the other side. In use, the glove attachment device 50 attaches to the glove as described below.

Figure 5:
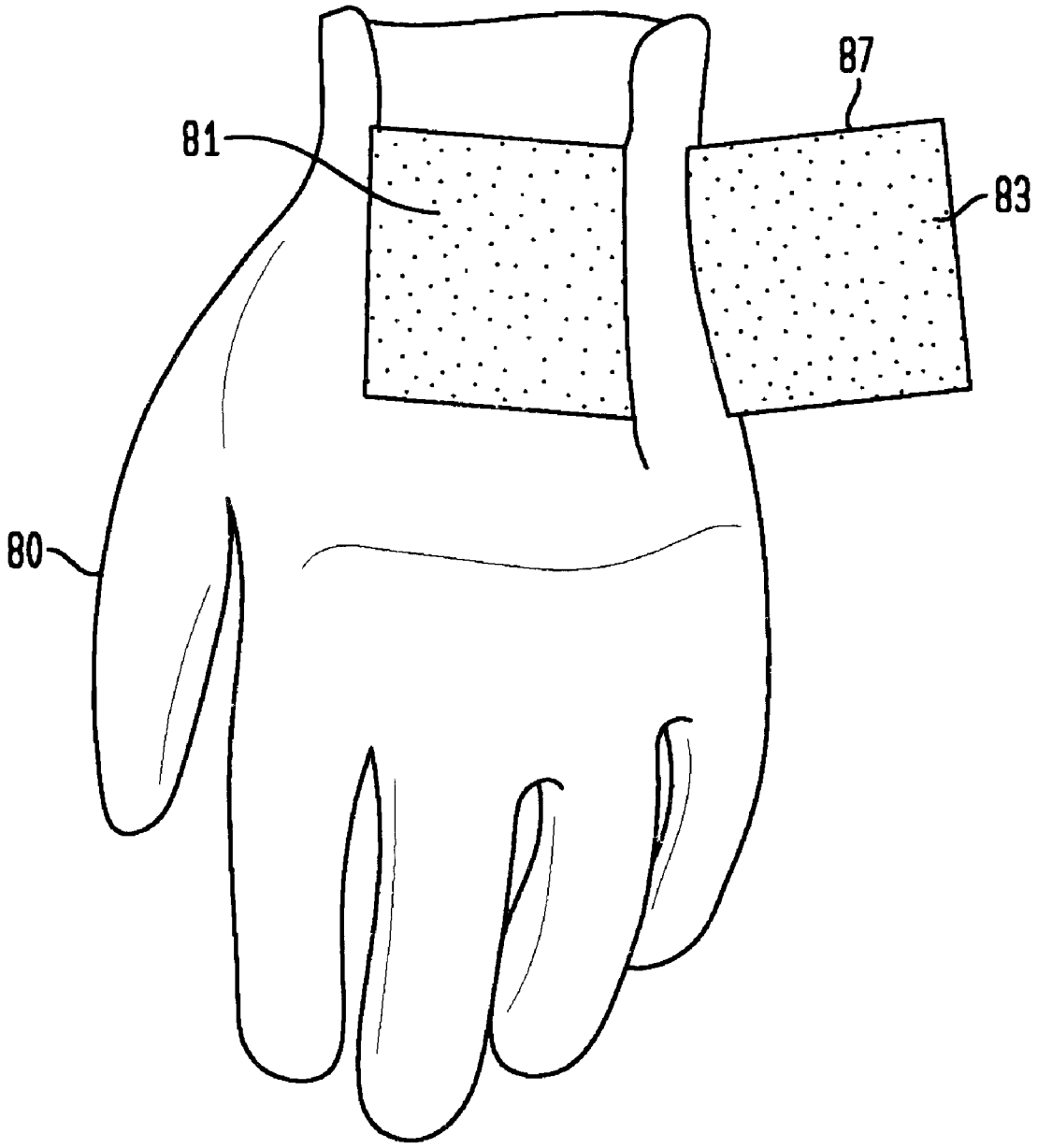
FIG. 5 (PRIOR ART)
FIG. 5 is a back view of a sporting glove, in accordance with the prior art.
Figure 6A:
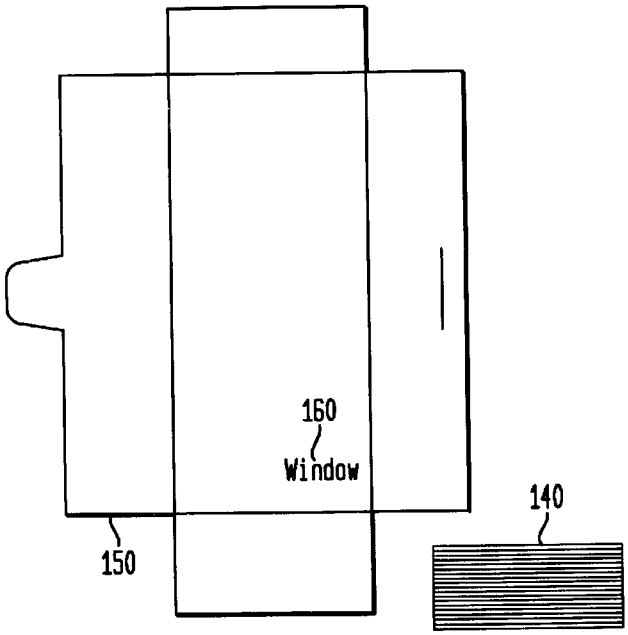
FIG. 6 is a series of views of an envelope for holding the self standing device of FIG. 4 in combination with a pair of gloves therein.
Figure 6B:
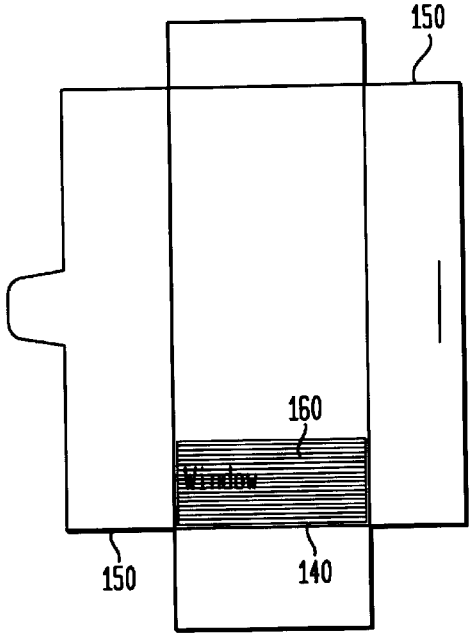
Figure 6C:
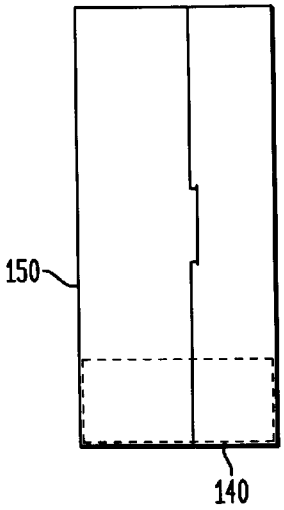
Figure 6D:
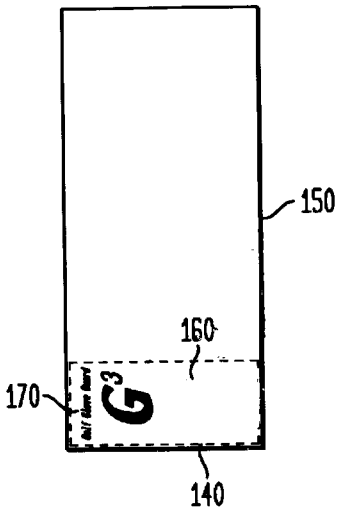

As is well known, sporting gloves include a strap 87 for securing the glove when the glove is attached to the user's hand. As shown in FIG. 5, this strap commonly includes hook tape 83 on one side which attach to pile tape 81 on the glove. The strap is pulled across the glove and then pressed downward so that the hook tape 83 attaches to the pile tape 81. By adjusting the degree to which the strap is pulled across, the user can adjust the tightness of the glove.

When the golfer's gloves become wet with perspiration, a golfer or other athlete attaches the accessory 10 to the vehicle 15, such as a golf cart. The card 40 of the accessory preferably includes promotional material 42 thereon which is prominently displayed when the vehicle is driven, yet which is easily attached to and removed therefrom.

As is well known, almost all sports gloves are provided with a Velcro (hook and pile tape) closure. Golf gloves with such a closure are shown, for example, in the patents cited above. In accordance with the present invention, the VELCRO (hook and pile tape) of the gloves attaches to the VELCRO (hook and pile tape) on the accessory (e.g on the card), allowing the gloves to be easily secured to the cart. In the preferred embodiment, the glove attachment device is inserted between the hook tape 83 and pile tape 81 of the glove to attach the glove to the glove attachment device. In other words, hook tape 76 of glove attachment device 50 mate with pile tape 81 of the glove, and pile tape 74 of the glove attachment device mate with the glove's hook tape 83. In this way, the glove 80 is securely attached to the glove attachment device 50.

Thus, in accordance with the invention, the gloves can be easily attached to a moving vehicle. In the preferred embodiment, when the golf cart is driven from hole to hole on the course (or after play is completed), the golf gloves—which are attached to the card 40—flap in the wind, quickly and efficiently drying them. Likewise, if the vehicle is a bicycle, the gloves can dry as the bicycle is being ridden. The gloves can also dry in the wind, of course, while the cart is stationary. However, attachment to a moving vehicle is particularly preferred, since the movement of the vehicle increases the rate of airflow against the glove, accelerating the rate of drying. The gloves are also always handily available close at hand for the golfer to retrieve whenever desired. Yet, the wet gloves do not hang uncomfortably against the golfer's clothing or pants.

In a further embodiment of the invention, the device is sold and directly packaged with sports gloves. In one embodiment, the gloves are golf gloves. In further embodiments, the gloves can be gloves for bicycling, baseball, or any other desired sport.

In yet a further embodiment, the card 40 is provided by itself, or packaged with sports gloves, for attachment to whatever is desired. This card can be attached to the surface of the vehicle, to other tags, or so forth.

In the case of golf, for example, most golf clubs already have standard club tags with the club name printed thereon. These tags are given out to members of the club for attachment to their golf bags for identification purposes. Those tags do not have any means for attaching gloves thereto, however. Prior devices, such as the device in the McGee patent, have required a redesign of those tags, and/or a replacement of large numbers of existing tags with an entirely new device.

In contrast, in accordance with the invention provided herein, a device is provided which can attach to existing tags, without needing replacement of those tages. As shown in FIG. 4, a self-standing card is provided which adheres to plastic tags of the type frequently given out at golf courses. The back of the card has a backing or removable adhesive cover 110; removal of this cover exposes adhesive 120. Preferably but not necessarily, this cover includes instructions for using the card or other wording as shown in FIG. 4*b*.

When the backing 110 is removed, the adhesive 120 is exposed. Card 100 includes a hinge region 130, along which the card can be folded. This hinge region is an area of the card between the hook portion 126 and the pile tape portion 136. If desired, this region can be a blank space, or, it can be an edge where the hook region and the pile region meet. The hinge region can also be an area of the card provided with dotted lines to indicate folding, or it can be a portion of the card with a "half-cut", i.e. a portion with an indentation therein to facilitate folding.

Figure 4A:
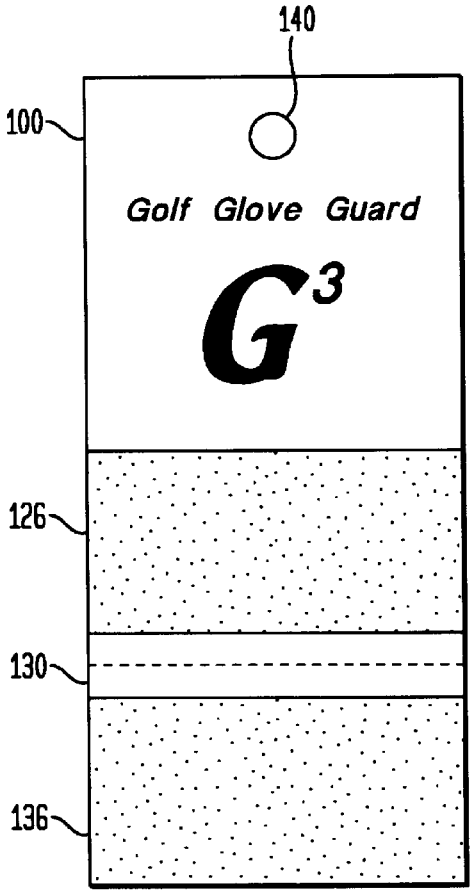
FIG. 4*a* is a front view of a self-standing accessory device in accordance with a further embodiment of the present invention.
Figure 4B:
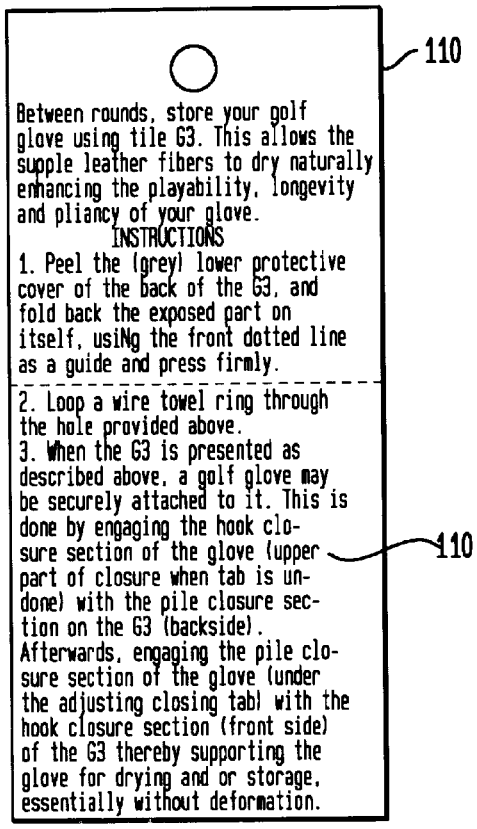
FIG. 4*b* is a back view of the device of FIG. 4*a*.
Figure 4C:
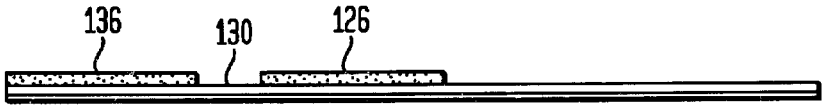
FIG. 4*c* is a schematic side view of the card of FIGS. 4*a*–4*b*.
Figure 4D:
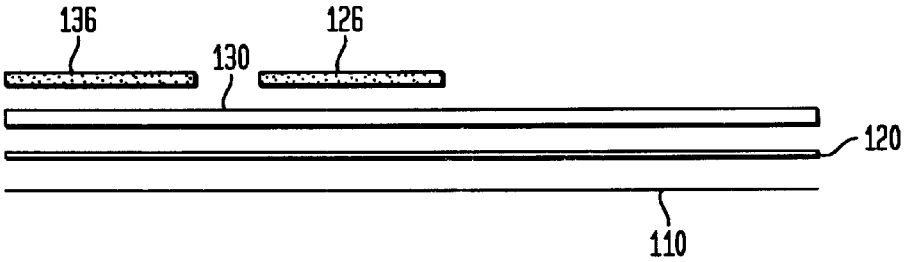
FIG. 4*d* is a detailed side view of the cards of FIGS. 4*a*–4*c*.

In the preferred embodiment, the card has hook portion 126 and pile tape portion 136 on the same side of the card, as shown in FIG. 4*a*. During use, the backing is removed to expose the adhesive 120 on the back of the card. The card is then folded back on itself in the hinge region 130, so that the back of the card behind the pile region and the back of the card behind the hook region meet, such the card adheres to itself.

Alternatively, the card can be placed on an existing golf cart tag, such as a tag issued by a golf club. After removal of the backing 110, the card is placed onto the existing tag, with the card 100 overlapping the existing tag up to the hinge region 130. The back of the card 100 will then adhere to the front of the existing tag. The bottom of the card is then folded back so that the adhesive on back of the VELCRO pile region of the card adheres to the back of the existing tag, securing the card 100 to the existing tag.

Once the card has been adhered (either to itself or to an existing tag), a dual sided card is provided in which the front includes VELCRO hook tape and the back includes VELCRO piles. A sporting glove can then be adhered to this card as previously discussed. If self-adhered, the card can be attached to a desired device using a cord, strap, hook, or the like attached through the hole 140. Further alternatively, the card can be attached to any other surface, preferably a flat one by folding the tag back over the edge of the surface. Or, the card can be adhered flat, so that the card is not sandwiched between the hook tape and pile tape of the glove when in use (with the hook tape and pile tape at a zero degree angle to each other), but rather the hook tape and pile tape of the glove are flat and at 180 degrees to each other when attached to the card. In all embodiments, the card preferably also includes promotional material thereon, such as graphics or so forth for promoting the goods or services of a third party.

In a preferred embodiment, the length of the card is approximately 4.38 inches (+/−0.13 inches), the width of the card is approximately 2.00 inches (+/−0.13 inches), the length of the VELCRO pile and hook areas are each approximately 1.00 inches, the length of the blank area is approximately 0.38 inches (+/−0.06 inches), and the spacing of the top of the hole from the top of the card is approximately 0.25 inches (+/−0.05 inches). Any other desired dimensions, however, can be utilized consistent with the invention.

Figure 7A:
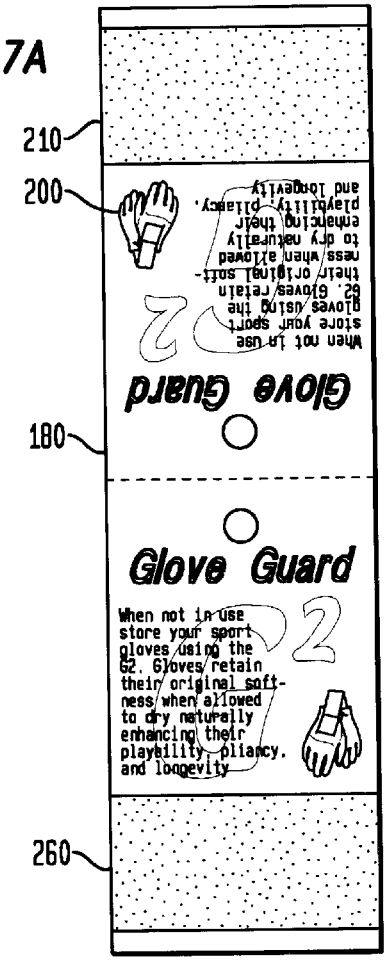
FIG. 7*a* is a top view of the card.
Figure 7B:
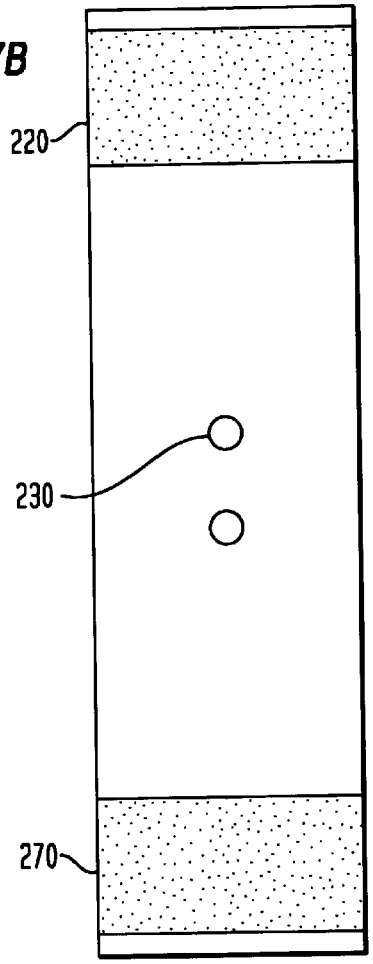
FIG. 7*b* is a bottom view of the card.
Figure 7C:
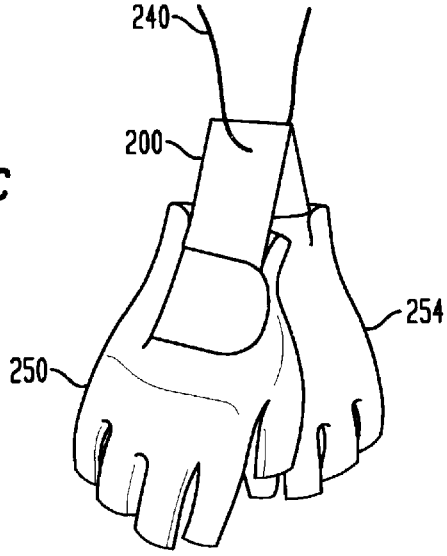
FIG. 7*c* is a perspective view of the card, hanging from a wire, and carrying a pair of gloves on a single card.

FIG. 7 illustrates a hanging card in a further embodiment of the invention, for holding two gloves on a single card. In this embodiment, hinge region 180 is provided approximately in the center of the card as shown in FIGS. 7*c*–7*c*. Card 200 is folded over itself at the hinge area 180. Hook tape 210 is provided at one end of the card with pile tape 220 on the obverse side of hook tape 210. Hook tape 260 is provided on the other end of the card with pile tape 270 on the obverse side of hook tape 260. When the card is folded over at region 180 a wire or cord 240 is threaded through holes 230 to suspend the card. Two gloves can both be attached to a single card, with a glove 250 attached to the hook tape 210 and pile tape 220 on one side of the card, and the other glove 254 attached to the hook tape 260 and the pile tape 270 on the other side of the card. This embodiment can be suspended from vehicles, or from any other desired object.

In a further embodiment of the invention, a package is provided as shown in FIG. 6. The package is in the form of an envelope 150, which is provided for including the glove and a card. Envelope 150 includes a window 160 to display a logo or trademark (e.g. $G^3$, a trademark of the present invention) on the card 140, and/or to display promotional material on the card. FIG. 6(*a*) is a back view of the envelope 150, wherein the envelope is in an open, unassembled state. FIG. 6(*b*) is a back view of the envelope 150 with a self-standing accessory device 140 positioned therein. The accessory device 140 is preferably like the device shown in FIG. 4. FIG. 6(*c*) is a back view of the envelope 150 in an assembled state, wherein the flaps have been folded over to contain the self-standing accessory device 140 therein. FIG. 6(*d*) is a view of the envelope 150 in an assembled state as in FIG. 6*c,* but turned over to display the front of the envelope. As shown in the figure, the self-standing accessory device 140 is positioned in the envelope to display desired material such as a logo, trademark or promotional material 170 through a window 160 in the envelope. Any other desired envelope or packaging can, of course, alternately be used in conjunction with the invention.

In a further embodiment of the invention, a receptacle is provided for containing the promotional material of the present invention, such that the promotional material can be removed and changed with ease. The promotional material in this embodiment (and in the other embodiments) is preferably printed on a card, but alternatively, can be located on some other medium, whether a flyer, or so forth. The receptacle can be an envelope, a hinged box with a clear panel, or any other container or holding mechanism. In a further embodiment, the receptacle can be a housing, and the promotional material can be located on a video screen in that housing (as with handheld devices such as Palm Pilots™ or so forth). In this manner, the same accessory can easily be used for one sponsor for a first period of time, for another sponsor for a subsequent period of time, and so forth, by merely changing the promotional material in the receptacle.

Figure 8A:
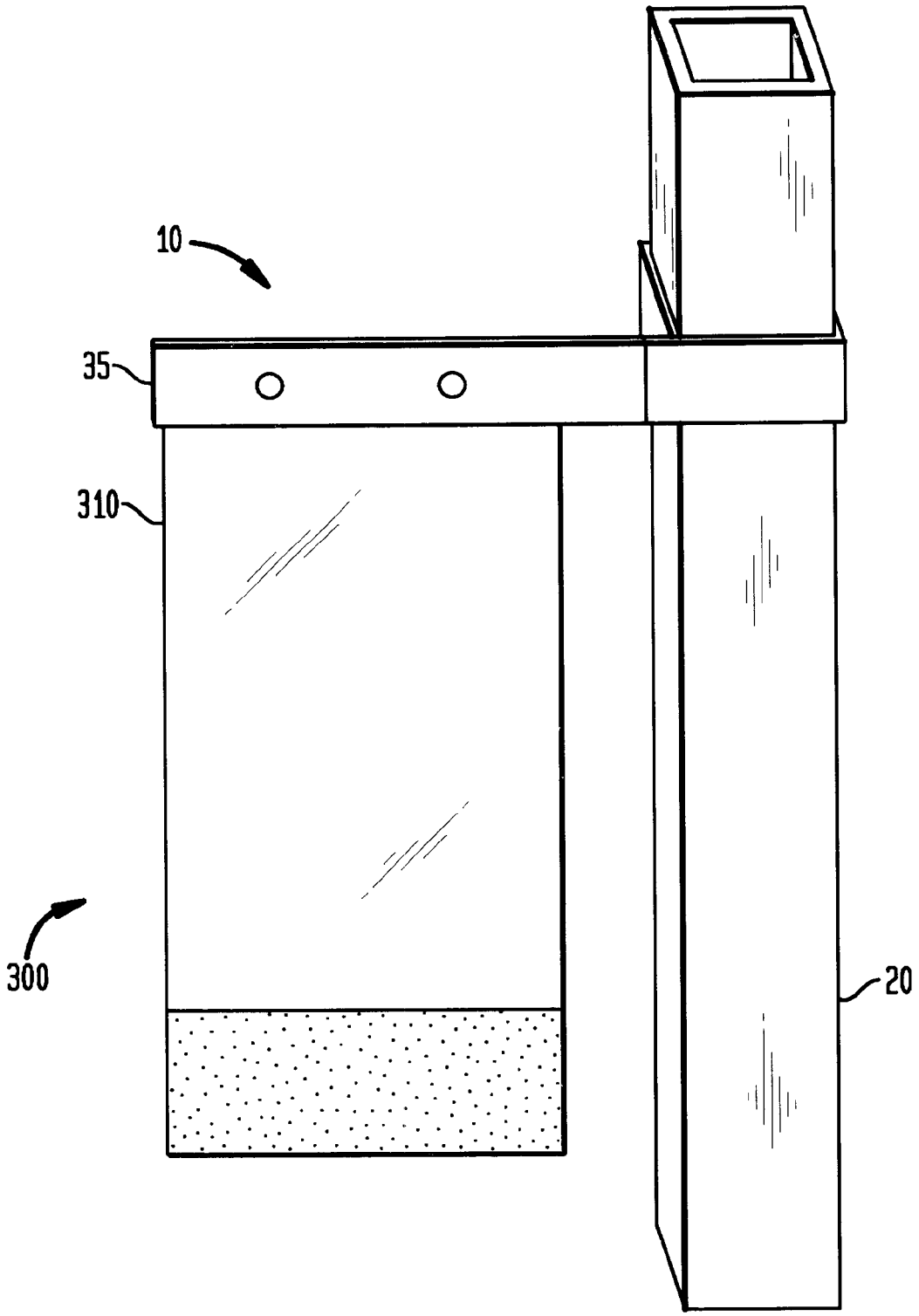
FIGS. 8*a–c* illustrate a further embodiment of the invention, in which a receptacle (e.g. a clear envelope) is provided for holding the card allowing cards to be inserted and removed therefrom.
Figure 8B:
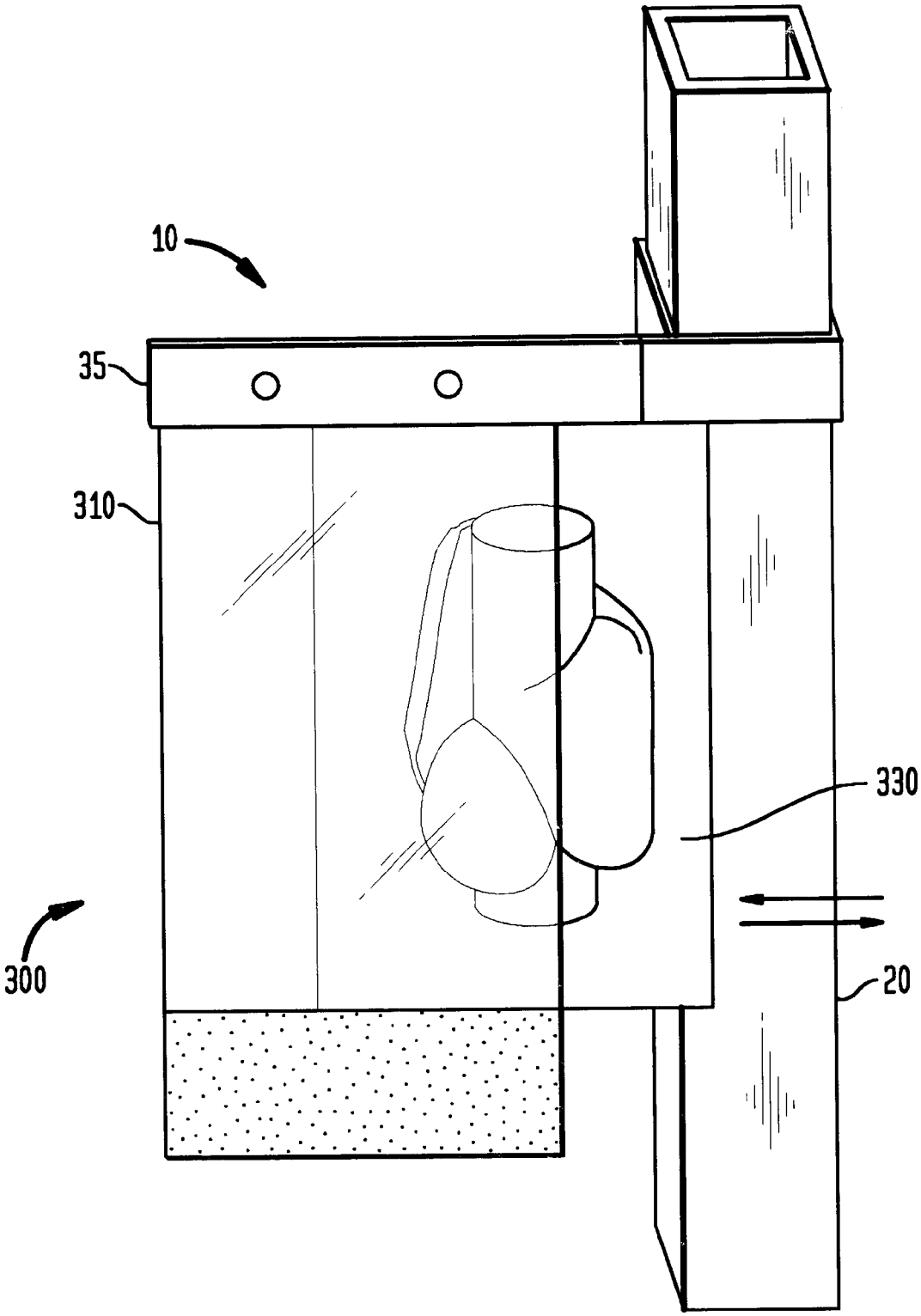
Figure 8C:
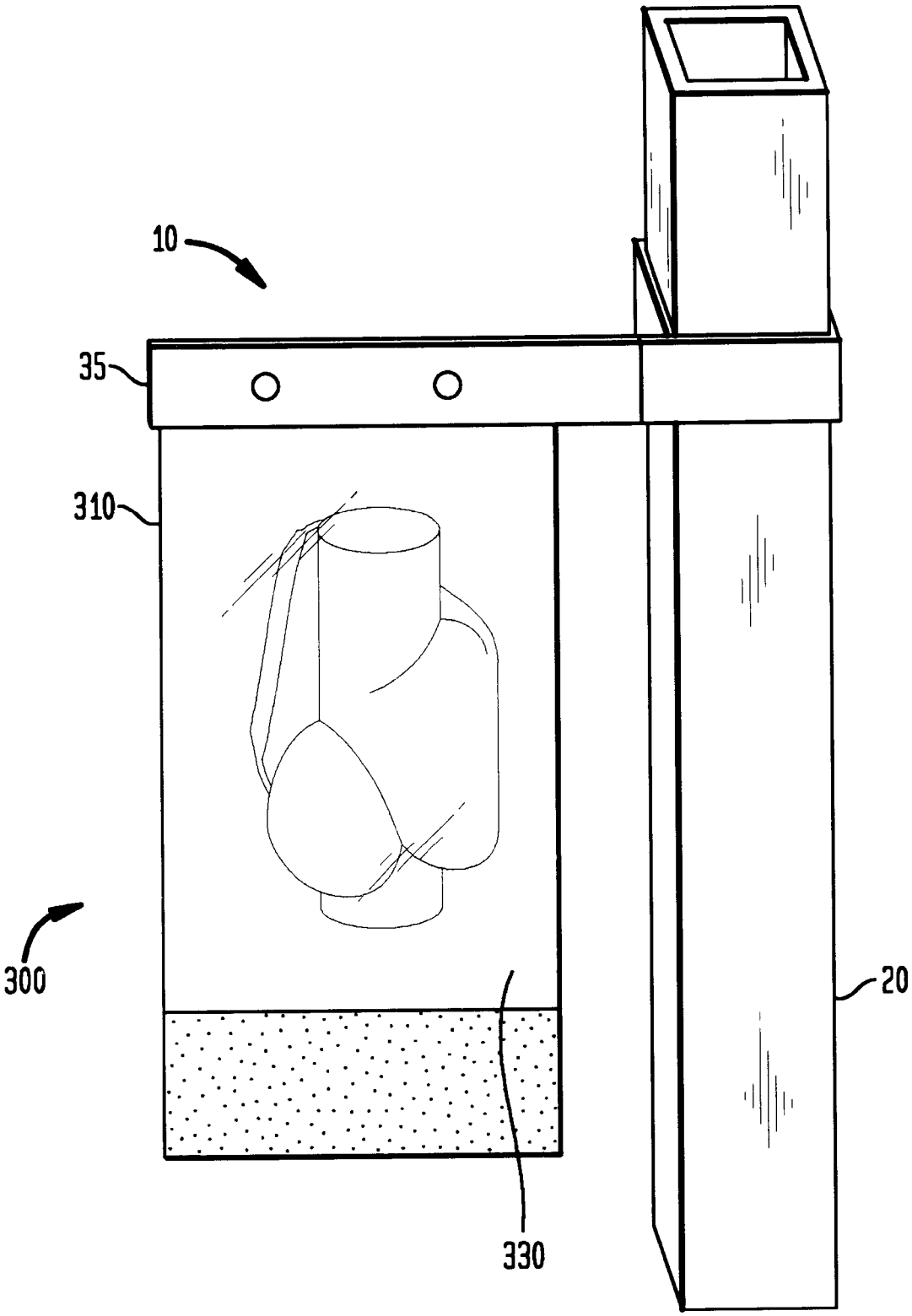

In one such embodiment, the receptacle is an envelope having a portion made of clear plastic and the promotional material is a card, allowing the promotional card to be easily exchanged, as shown in FIGS. 8*a*–8*c*. The promotional cards of the present invention (whether a single fixed card or interchangeable cards) are designed to provide sponsors of athletes and other advertisers with a further medium upon which advertising, logos, images, and other promotional material may be placed. In accordance with the embodiment of FIG. 8, these promotional cards can be easily exchanged. The illustrations show this embodiment with reference to the embodiments disclosed above for use with a vehicle; however, a receptacle or envelope can be used with any of the other embodiments of the present invention, as well.

As shown in FIGS. 8*a–c,* in one preferred further embodiment of the accessory 300, a clear envelope 310 is provided for holding the card 330. FIGS. 8*a,* 8*b* and 8*c* are perspective views of the accessory 300, showing the accessory before, during, and after insertion of the promotional card, respectively. In the embodiment shown, the cards are inserted through an opening in the side of the envelope; alternatively, the cards can be inserted through an opening in the top, or in a resealable bottom. In this manner, many promotional cards can be used with the same accessory by merely substituting the desired card 330 into clear PVC envelope 310 whenever desired.

Having described this invention with regard to specific embodiments, it is to be understood that the description is not meant as a limitation since further embodiments, modifications and variations may be apparent or may suggest themselves to those skilled in the art. It is intended that the present application cover all such embodiments, modifications and variations.

What is claimed is:

1. A glove drying apparatus, comprising:

(a) a device for drying gloves, said device comprising a card;

(b) said card comprising a hinge region such that said card can be folded over at said hinge region;

(c) said card comprising a first attachment device for a first glove;

(d) said card further comprising a second attachment device for a second glove;

(e) such that said card is attachable to two gloves for drying both gloves simultaneously.

2. An apparatus as claimed in claim 1, wherein said first attachment device comprises a first hook tape and a first pile tape, and wherein said second attachment device comprises a second hook tape and a second pile tape.

3. An apparatus as claimed in claim 1, wherein said gloves are sports gloves.

4. An apparatus claimed in claim, wherein said gloves are golf gloves.

5. An apparatus as claimed in claim 1, wherein said card further comprises promotional material thereon.

6. An advertising and glove drying apparatus, comprising:

(a) an advertising apparatus, said apparatus comprising a vehicle securing device;

(b) said apparatus further comprising a display and at least one exchangeable card, said display comprising a clear envelope such that said card can be inserted into and removed from said envelope, said card having promotional information provided thereon; and, (c) a glove attachment device for suspending gloves from said apparatus for drying, said glove attachment device comprising hook and pile tape for attachment to a glove.

7. An apparatus as claimed in claim 6, wherein said vehicle securing device comprises a strap.

8. An apparatus as claimed in claim 6, wherein said vehicle securing device comprises a device for attachment to a golf cart.

9. An apparatus as claimed in claim 6, wherein said vehicle securing device comprises a device for attachment to the upright poles of a golf cart.

10. An apparatus as claimed in claim 6, wherein said vehicle securing device comprises a device for attachment to a bicycle.

* * * * *